United States Patent [19]

Benoit et al.

[11] 4,110,856

[45] Sep. 5, 1978

[54] HOSPITAL BED

[75] Inventors: Roland A. Benoit, Danielson; Edmond P. Guillot, Putnam, both of Conn.

[73] Assignee: InterRoyal Corporation, New York, N.Y.

[21] Appl. No.: 789,043

[22] Filed: Apr. 20, 1977

[51] Int. Cl.[2] ..... A61G 7/10

[52] U.S. Cl. ..... 5/68; 5/66

[58] Field of Search ..... 5/60, 92, 66–68

[56] References Cited

U.S. PATENT DOCUMENTS

| | | | |
|---|---|---|---|
| 3,201,806 | 8/1965 | Hutt | 5/66 |
| 3,972,081 | 8/1976 | Stern et al. | 5/68 |
| 4,025,972 | 5/1977 | Adams et al. | 5/63 |

*Primary Examiner*—Casmir A. Nunberg
*Attorney, Agent, or Firm*—Arthur A. March

[57] ABSTRACT

The invention is a new hospital bed having a lower frame or dolly, an upper frame or mattress support, and a middle frame comprising two longitudinal beams, a head end, a foot end and a central section. The head end is formed by a single "U" shaped tube which joins the beams, holds a head board, supports the side rails, and provides recesses for IV tube support rods; the foot end is formed by a single channel having similar and additional functions as the head end; and the central section of the middle frame includes a pair of wing-like plates which form a part of and provide the principal support for the upper frame. The total number of components of the bed is substantially reduced by the design of these components to serve multiple functions, which conserves material, reduces expense, and allows for easier repair and adjustment. Drive mechanisms cause the middle frame to rise or descend, the head end and foot end to tilt upward and downward, and the upper frame to bend, thereby tilting the head, thigh and leg sections independently.

17 Claims, 13 Drawing Figures

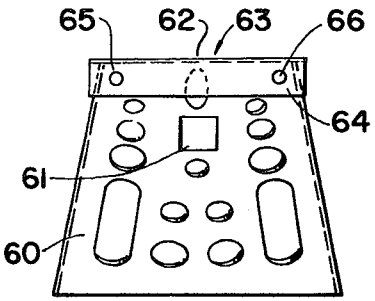
FIG. 10
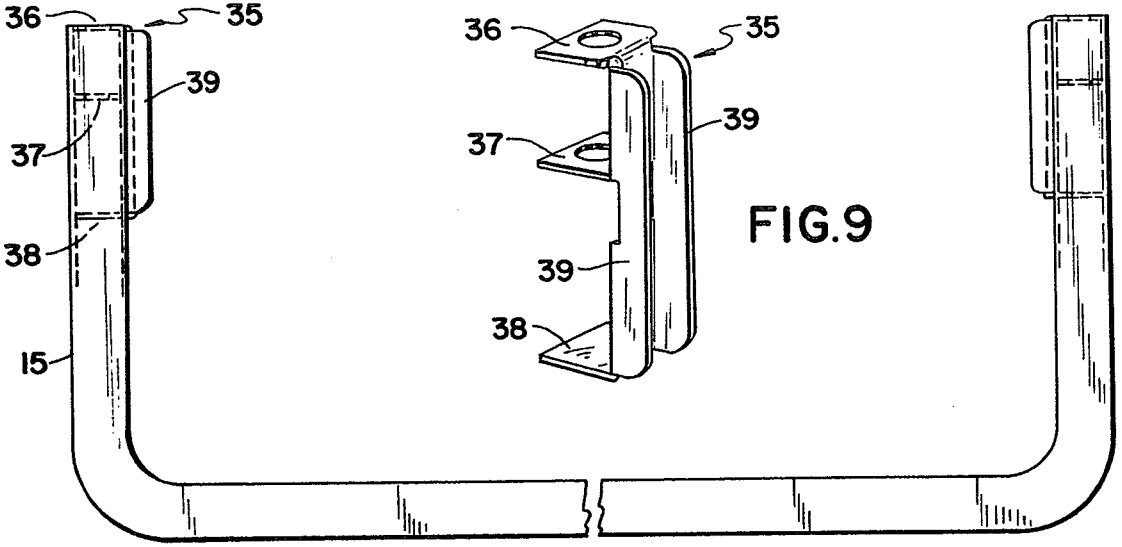
FIG. 8
FIG. 9
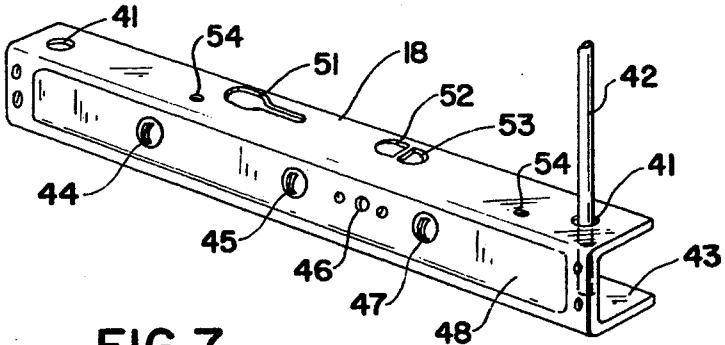
FIG. 7

HOSPITAL BED

BACKGROUND OF THE INVENTION

This invention is in the field of hospital beds which typically have a lower support frame which may be raised, lowered, or tilted between shock and drainage positions, and an upper frame or mattress support formed of a head section, a thigh section, and a leg section, which are independently tiltable. Thus the head section can be raised to any angle, while the thigh and leg sections remain flat, or vice versa; or the head and thigh sections can be tilted to form a "V", while the thigh and leg sections form an inverted "V". There are obviously a great many possible angles and configurations to satisfy the patient's needs for comfort and medical reasons.

The lower frame may comprise a dolly or carriage on wheels at the bottom, and above it a middle frame which is movable relative to the carriage by known drive means normally operated by cranks extending from the foot-end of the bed or by electric motors. The drive means normally include long drive shafts extending from the crank at the foot-end to a lever below and engaging each of the movable sections of the upper frame. The crank handles are usually designed to pivot relative to the shaft or be totally removable, so as to avoid being an obstacle to persons walking past the foot-end of the bed. Protective side rails extend between the head and foot ends of the bed, these rails being movable in any feasible manner such as pivoting about longitudinal or transverse axes, or even being removable.

The above described hospital beds having provision for various movements and configuration, are generally known in the prior art and may be seen in a variety of publications. They have been described at this time merely to demonstrate the environment in which the present invention is an improvement. These hospital beds are made in great numbers, and at present are relatively complex, quite expensive, and not always reliable to function as intended. Obviously, high cost is a problem in view of present economies; of equal or greater concern is poor reliability, because in actual use there will be little opportunity for correction of malfunction while a patient is in or waiting for the bed.

It is an objective of this invention to provide an improved hospital bed wherein the usual features are retained, additional adjustments may be provided, and the entire mechanism is manufacturable for a substantially reduced cost compared to standard prior art beds. Another consideration in this period is a general policy and desire for conservation of materials and energy, which is attempted by designing the new bed to have fewer parts, to use less material, and to have configurations which produce less scrap or provide uses for the scrap. These objectives have been largely achieved by simplifying parts and mechanisms, and specifically by causing certain single components to serve two, three or more functions. Presented below is a summary of the invention as regards the general concept, followed by a detailed description of the preferred embodiments of this invention.

SUMMARY OF THE INVENTION

The invention is a new hospital bed made with fewer parts and simpler construction than related prior art beds, this being achieved by the use of components which have new forms and serve multiple functions, and thus replace a plurality of other parts and result in a more reliable and more economical apparatus. The bed comprises a lower frame or dolly, an upper frame or mattress support, and between these two frames a new middle frame formed by two longitudinal beams which are joined at the head and the foot end. The head end of this middle frame comprises a single "U" shaped tube which joins the beams, holds a head board, supports movable side rails, and provides recesses for receiving and holding vertically IV tube support rods. The foot end of the middle frame is formed by a single channel member which serves the same functions as the head end, and also supports the crank rods of all the drive mechanisms which adjust the bed's shape and orientation. Wing-like plates extending from the middle frame form a part of and provide the principal support for the upper frame, and also provide still additional recesses for IV support rods mid-length of the bed. Not only do the fewer components reduce material expense and simplify construction, but certain of these components are designed so that the resultant scrap can also be used elsewhere, which furthers the additional objective of conservation of material and energy.

This new hospital bed invention focuses generally on the middle frame part between the lower carriage and the upper mattress support, and focuses specifically on a variety of new concepts and structures to create this middle frame.

First consider the improved head-end of the middle frame which traverses and joins first ends of the two longitudinal beams. This head-end comprises a tube having square or other cross-section bent into a "U" shape and situated in a vertical position. The bottom of the "U" joins the two longitudinal beams, and the top ends of the arms of the "U" extending upwardly are open so that an IV tube support rod can be inserted into an arm and maintained vertically, which eliminates the usual need for separate brackets to hold the IV support rod.

Near the mid-length portion of the frame on each of the beams is a support plate to which is pivotally mounted portions of the upper frame. In a perspective view, these plates extend both laterally and upwardly like short wings. Each plate is made from a single sheet of metal having a plurality of punched apertures to lighten the plate and provide punched out elements which are usuable in other parts of the bed assembly, and which constitute a saving of metal which otherwise would be completely wasted.

At the foot end of the frame is a transversely extending channel, which is formed from a single piece of metal bent into the channel shape. The channel is oriented such that in cross-section it appears as a "C" with the open end of the "C" facing rearward away from the head-end of the bed, thus providing top and bottom flanges and a vertical end-wall. In the end-wall are apertures through which extend crank rods for the driving mechanisms which move the upper mattress frame as desired. On the top flange of the channel are various apertures for receiving and storing a crank and/or other components. Finally, near the ends of the top flange there are holes for receiving IV tube support rods, similarly as at the head-end of the bed, thus providing additional, optional supports for the IV rods and traction frames. At each corner of the foot-end channel is a bracket having one arm welded to the channel, a center part to which is mounted the foot board, and a second arm for pivotally supporting one end of the movable side rail which extends the full length of the bed, and is engaged to a somewhat similar bracket at the head-end of the bed. The entire side rail is a generally rectangular, tubular structure which pivots in a clockwise movement to an upward position designed to prevent a patient from falling out of the bed, and downward to provide free access to the mattress.

The bed frame is made almost entirely from welded square tubular members which provide strength and simplicity in construction, and provide the additional advantage of storage space within the bores of the tubes, particularly for IV support rods or other equipment as desired.

In summary this invention provides a hospital bed based upon new concepts of simple, efficient structures, by discarding the standard hospital bed designs which have become more complex and expensive and less reliable, and by providing a new apparatus having a basis of multiple functions instead of the prior art beds which merely added more structure for each new function that was needed or discovered. A preferred embodiment of the invention is described in detail in the following sections with reference to the attached drawings.

BRIEF DESCRIPTION OF THE DRAWINGS

FIG. 7 is a perspective view of the foot-end channel seen in FIG. 3.

FIG. 8 is an end elevation view of the head-end frame seen in FIGS. 1 and 3.

FIG. 9 is a perspective view of a head board bracket attached to the head end frame of FIG. 8.

FIG. 10 is an auxiliary plan view of the mounting plate seen in FIGS. 1 and 3.

DETAILED DESCRIPTION OF THE PREFERRED EMBODIMENTS

Figure 1:
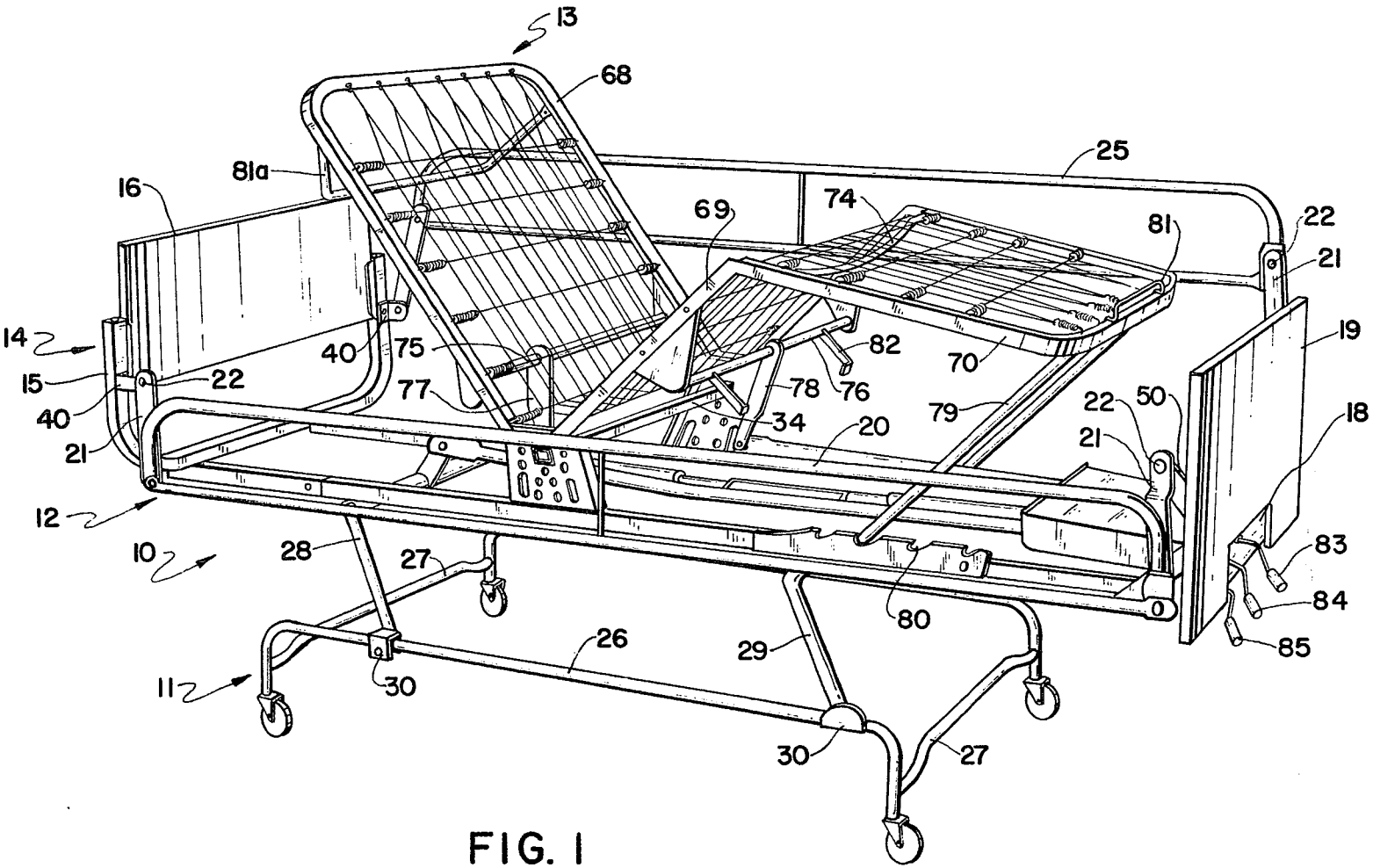
FIG. 1 is a perspective view of a hospital bed showing my new invention.
Figure 4:
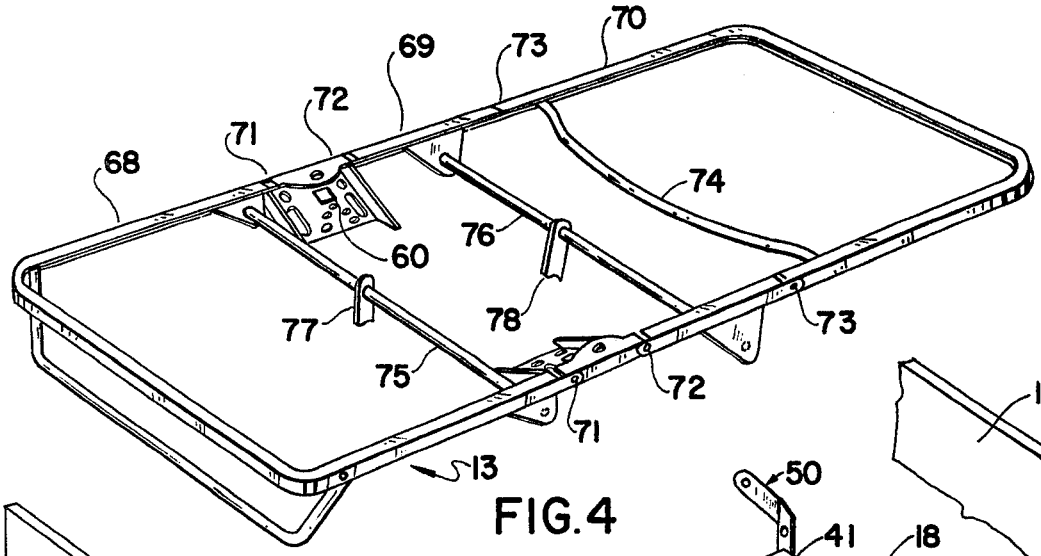
FIG. 4 is a perspective view of the upper frame or mattress support portion of the bed shown in FIG. 1.
Figure 3:
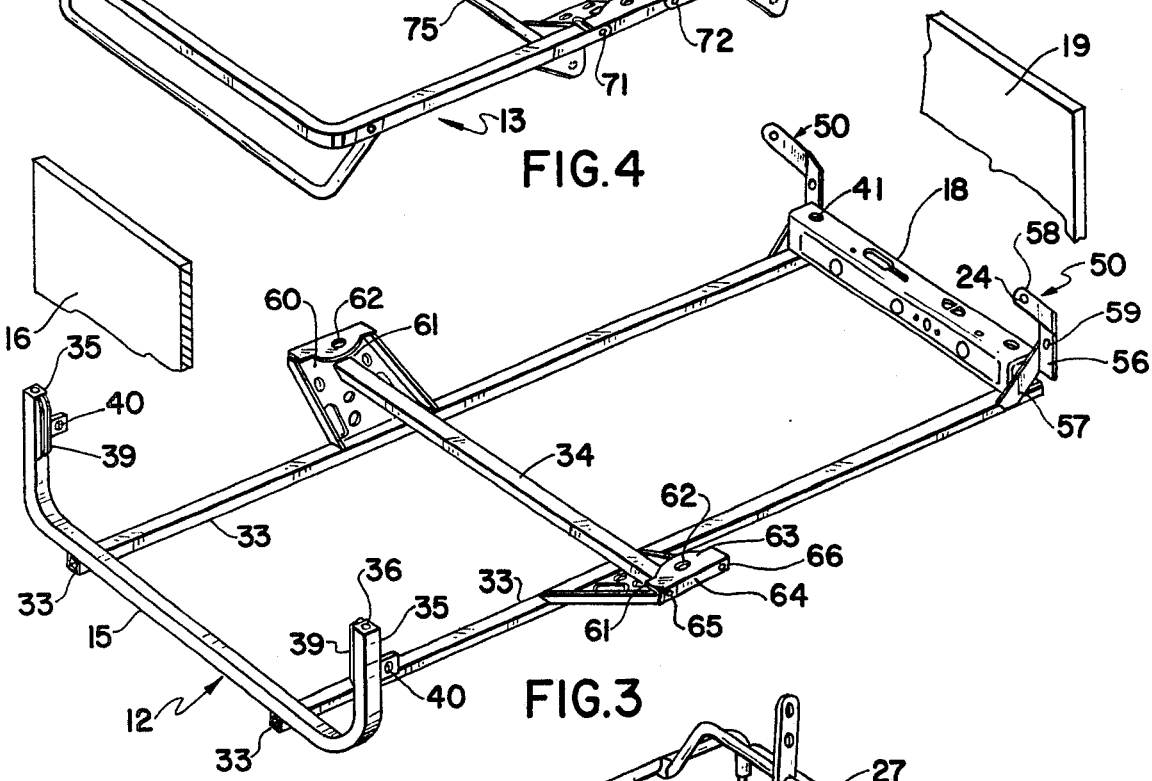
FIG. 3 is a perspective view of the middle frame portion of the bed shown in FIG. 1.
Figure 2:
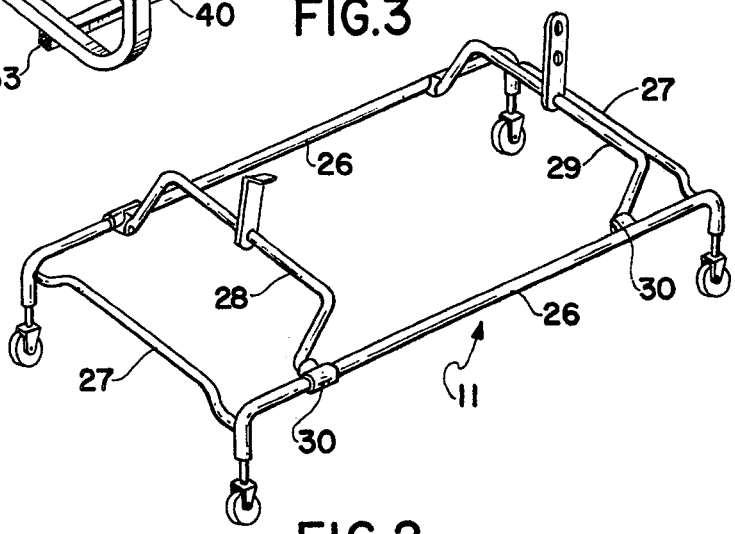
FIG. 2 is a perspective view of the lower carriage portion of the bed shown in FIG. 1.

FIG. 1 shows a fully assembled hospital bed embodying features of my new invention; FIGS. 2, 3, and 4 illustrate the three principal sub-assemblies which together provide the bed of FIG. 1.

Figure 5:
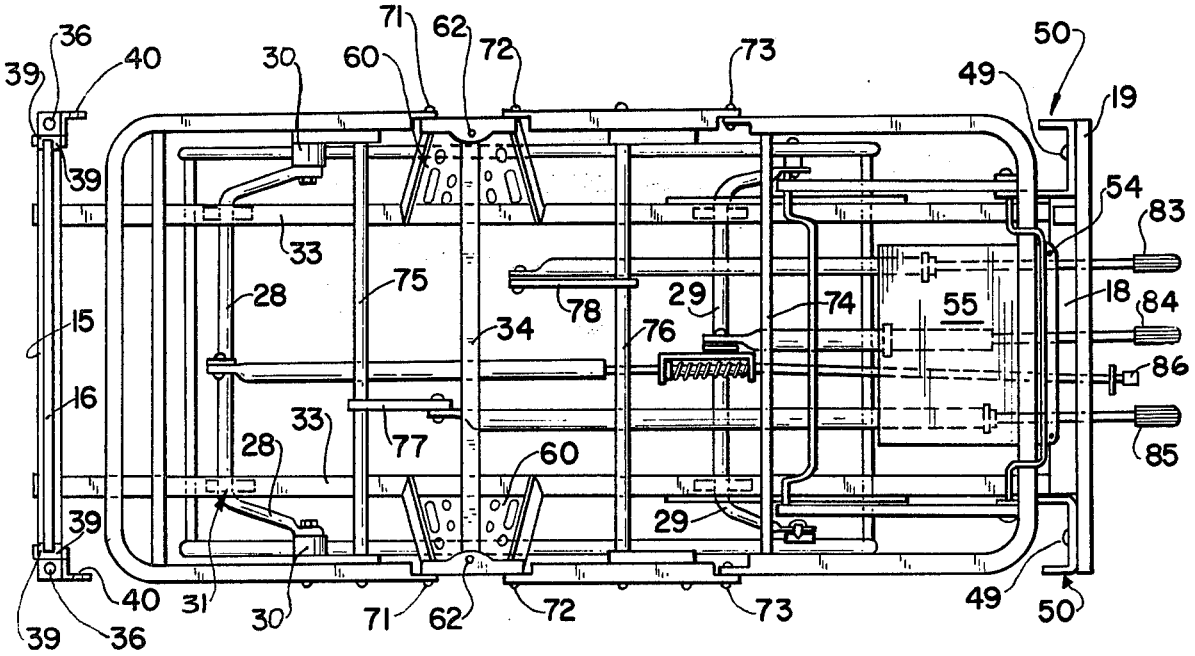
FIG. 5 is a top plan view of the bed shown in FIG. 1.
Figure 6:
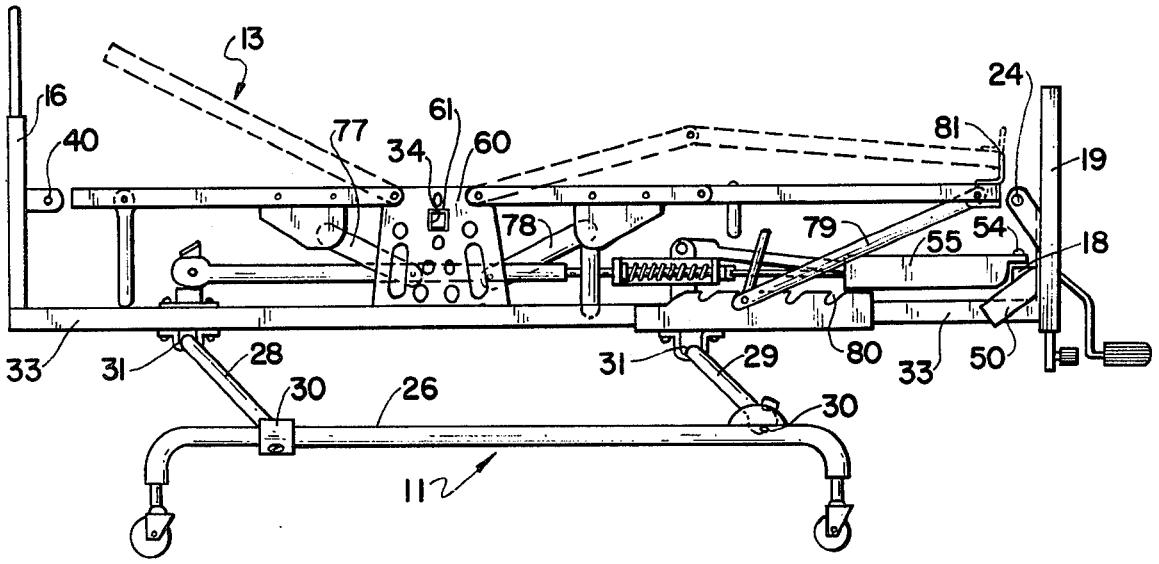
FIG. 6 is a side elevation view of the bed shown in FIGS. 5 and 1.
Figure 11:
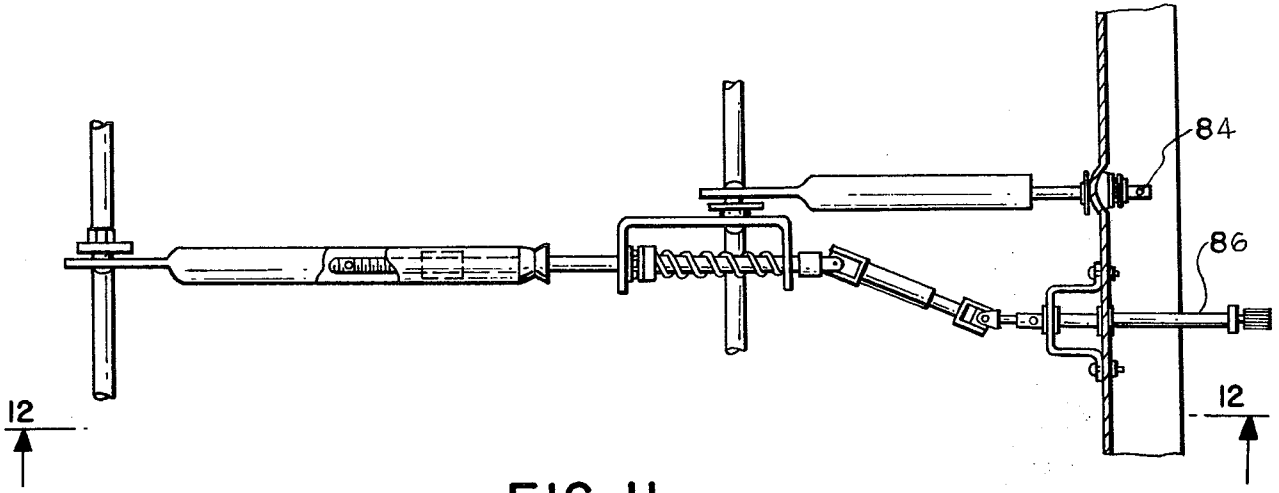
FIG. 11 is a top plan view of the drive mechanism for raising, lowering, and tipping the middle frame relative to the lower carriage.
Figure 12:
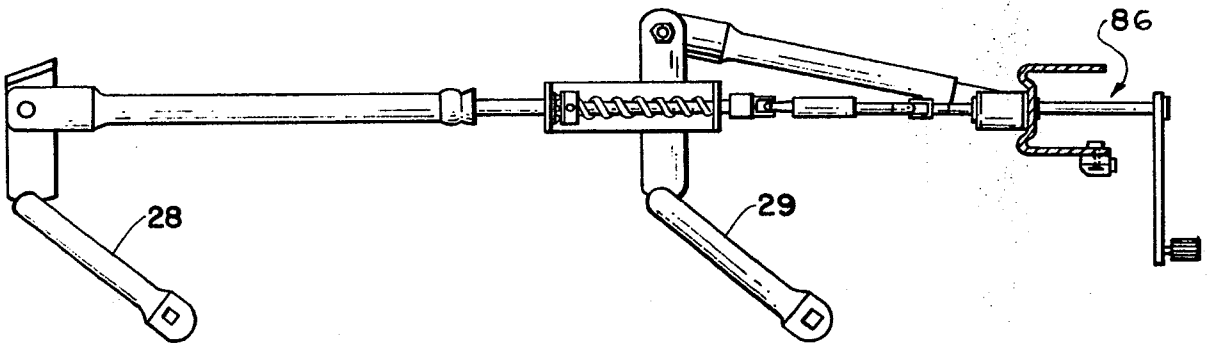
FIG. 12 is a side elevation view of the drive mechanism shown in FIG. 11.

At the base of the hospital bed 10 in FIG. 1 is a lower frame or wheeled dolly 11 which is shown separately in FIG. 2. This lower frame is made of two side rails 26 joined by two transverse rails 27, and at the head end, "U" shaped elevation arm 28, and at the foot-end a similar elevation arm 29, these arms being pivotable at junctions 30 on rail 26 and above at junctions 31 where this elevation arm engages the middle frame 12 as shown in FIGS. 5 and 6. The drive mechanism for causing the elevation arms to raise or tilt the middle and upper frames 12 and 13 will be described in later paragraphs.

FIG. 3 shows the middle frame 12 formed by two square tubular members 33 joined at the head end by frame 15, at the foot end by channel 18, and at the middle by transverse tube 34. Fixed junctions between members, such as head end frame 15 and longitudinal rails 33, may be made by welding as shown, or by fasteners or other means.

The frame 15 is made of a square tube bent into a "U" shape as indicated and modified by the attachment of head board bracket 35 on each upward extending arm of the "U" shaped tube. The bracket is shown in detail in FIG. 9 where it has top shelf 36, middle shelf 37, and bottom shelf 38, all of which are inserted and welded into the upper end of each arm of the "U" shaped frame 15, as indicated in FIG. 8. Blades 39 on each of the brackets 35, are bent from the original flat sheet of metal from which this bracket was formed. Blades 39 in each bracket define between them a channel, and the channels of the two brackets have their open sides facing each other to define a guide space in which head board 16 may be slid and held securely. As may be seen in FIG. 9 and FIG. 3, the top plate 36 and the middle plate 37 of bracket 35 have round holes which are aligned and designed to receive the bottom end of an IV support rod. After the rod is inserted downward through the first two holes, it will be stopped by bottom plate 38 and safely supported there. It should also be noted that middle plate 37 has been bent upward from the adjacent portion of the bracket, and top plate 36 was bent downward; thus the entire bracket was formed from a single sheet of metal punched in flat condition. Finally, there are tabs 40 welded to each of the legs of head-end frame 15 for receiving the pivot connection of the side rails which will be discussed later.

At the foot-end of the middle frame shown in FIG. 3 is a channel member 18 which is also shown in detail in FIG. 7. In FIG. 3 the ends of the channel are welded to longitudinal beams 33, with the open side of the channel facing outward. Apertures 41 at each end of the channel are intended to receive the base end of an IV rod 42 as shown in FIG. 7, with the lower flange 43 of the channel supporting the rod to stand vertically and secure. Apertures 44, 45, 46, and 47 in the front face 48 of the channel receive cranks and associated drive mechanisms for changing positions and angles of portions of the bed as will be explained later. Finally, apertures 51, 52 and 53 provide space for storing certain components when desired. Also apertures 54 near each end of the upper flange of the channel are intended to receive fasteners that hold on a cover plate 55 illustrated in FIGS. 5 and 6.

Bracket 50 has a back plate 56, a lower arm 57 which is welded to rail 33, and an upper arm 58 with pivot hole 24 for a pivotal connection to the side rail. In the center of plate 56 is a hole 59, and through the holes 59 in the two brackets 50 are inserted bolts 49 which engage and secure the foot board 19 in place as seen in FIGS. 3 and 5.

Near the middle portion of frame 12 in FIG. 3, a plate 60 is welded to each side rail 33, the plate positioned to extend upward and outward at an angle somewhat like a wing. A square tube 34 spans the space between the two plates, with its ends welded near the centers of the plates, and with the aperture of tube 34 aligned with holes 61 in the plates. In the assembled bed the tube 34 is exposed and open from the side, and can be used for storage of IV rods which are otherwise inserted in holes 36 in the head frame, or holes 41 in the foot-end channel. There are additional holes 62 in each of the center plates 60 which constitute an additional location for supporting IV rods in a vertical position. In FIG. 10 the plate 60 is shown in more detail, wherein there is a top plate 63 and a side flange 64 with apertures 65 and 66 for engaging portions of the upper frame as will be discussed later. As illustrated in FIG. 10, there is a small hole forming a guide for receiving an IV rod in the edge portion of the top plate 63. Thus such a rod can be accommodated in the mid-section of the bed when it is desired to do so as opposed to being accommodated at one of the head or foot ends 10. Plate 60 has numerous other apertures punched out of it, which provide a plurality of metal slugs to be used as washers or other items in this and other assemblies.

FIG. 4 shows the upper or mattress support frame 13 which comprises head section 68, thigh section 69 and foot section 70. The head section 68 is a "U" shaped angle member having its ends pivotally connected at 71 to apertures 65 of the support plates 60. The thigh section 69 has its head end connected pivotally at 72 to apertures 66 of the support plate 60 as shown in FIG. 4. Finally, foot section 70 is another "U" shaped member joined at 73 to the extending ends of the thigh section. There is a cross member 74 secured to ends of the foot end section 70, and another cross member 75 secured near ends of the head section 68. A cross member 76 is secured to the rails of the thigh section.

Figure 13:
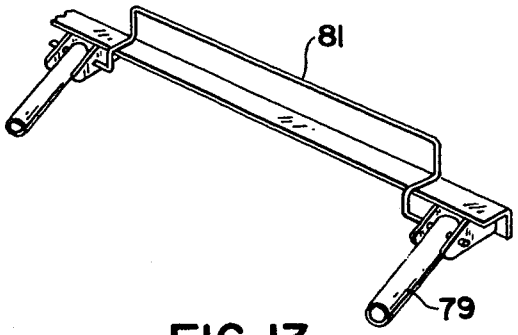
FIG. 13 is a perspective view of the combined handle and mattress retainer.

As can be seen in FIGS. 1 and 4 the head section 68, thigh section 69 and the foot section 70 are each pivotable generally independently of each other. A drive member 77 may be actuated to push cross bar 75 and the associated head section upward; a similar drive member 78 engaged to cross bar 76 can be driven to raise the thigh section as shown. Legs 79 are provided to support the leg section 70 of the upper or mattress frame, the legs 79 being manually positionable in grooves 80 as shown in FIG. 1, to determine the final position of the leg section 70. At the end of leg section 70 is an element 81 which appears in FIGS. 1 and 5 and in detail in FIG. 13, and has multiple functions: its ends are bent to serve as pivots for the legs 79, the bar itself is a handle for lifting section 70, it serves as a mattress retainer, and it can pivot about its ends to fold down for shipping. As is evident, the foot section is coupled to the thigh section, and the thigh section and head sections are coupled to the seat plate which is the basic support for the whole upper frame. There is a support 81*a* to act as a stop for the head section when it is lowered to a horizontal position, and another stop 82 to locate the thigh section in a horizontal position.

Next consider the drive mechanism for raising and lowering the head and thigh sections of the upper frame. There are three cranks 83, 84 and 85, illustrated in FIG. 1, FIG. 5 and FIG. 6. Crank 85 extends forward as shown in FIG. 5 to elevation arm 77 which pushes the head section 68 of the upper frame upward as illustrated in FIGS. 1 and 4. Crank 83 extends forward as shown in FIG. 5 to elevation arm 78 for driving thigh section 69 upward as shown in FIGS. 1 and 4.

The middle crank 84 has the purpose of elevating the entire middle frame relative to the dolly by driving both elevating arms 28 and 29 as shown in FIGS. 1, 5, 6, 2, and 12; crank 86 drives only elevating arm 28 to raise the head end independently of the rest of the upper frame. Thus it is possible to tilt the middle frame in such a way that the head can be down relative to the foot end to orient the patient in shock position, or tilted with the foot end lower than the head end to orient the patient in drainage position. It is assumed that these orientations will be established when the upper frame is in a generally flat and horizontal condition so that the movement of the middle frame will achieve the intended effect.

Now consider the large number of components of this new bed which serve two or more functions simultaneously. The head end frame which is "U" shaped serves not only to unite the side rails 33 into a rigid middle frame member, but also provides a pair of tracks to receive the head board 16, and also is hollow with guide holes 36 at the top for receiving IV rod supports, and also has thereon mounting ears 40 for receiving the side rail 20. At the foot end of the bed the channel member 18 first joins the foot ends of rails 33 into the rigid middle frame; the channel also provides receptacles for IV rods to be held in a vertical support; also this channel receives all the crank mechanisms for driving different parts of the bed, and has additional apertures for storage of other components. The support plate 60 in combination with beam 34 makes rigid the entire frame by joining it at its middle section, and also provides mounting means for engaging and supporting the entire upper mattress support frame, and as mentioned earlier, the beam 34 is hollow for receiving in storage the IV rods which may be used on parts of the bed. Finally, this plate has holes on top and bottom for receiving the IV rods, should it be desired to place them in the middle of the bed. Returning to the foot end of the bed, the brackets 50 also provide multiple functions, as is achieved with other components. Each bracket is first secured by welding to the middle frame, then has an aperture in the back plate for holding up the foot board 19, and finally has an upward extending arm 58 for engaging one portion of the side rail.

I have thus provided a very strong and reliable bed frame which is remarkably simple in having very few components, most of which serve two, three or four functions; this not only simplifies construction, but it substantially reduces ultimate cost. The tubular structure is very simple, strong and inexpensive, and easy to weld because the flat surfaces of the square cross-section tubes are easy to fit with adjacent square tubes.

A few other elements or components of the bed are the following. In FIG. 1 and elsewhere there are cranks 83, 84 and 85 which are typically pivotable downward to be out of the way, and may be either removable or permanently attached to the shafts they drive. The side rails 20 and 25 shown in FIG. 1 are rectangular frames; each is moved upward by rotating the entire frame in a generally clockwise motion about pivot arms 21 which pivot about point 27.

Throughout the construction and design of this bed, there has been not only the philosophy of simplifying and economizing, but also the concept of conserving material by utilizing leftover pieces where possible. This has been extended to create leftover pieces such as by punching the variety of holes in the support plate 60 which provide a corresponding variety of punchouts or slugs which are used elsewhere in this apparatus or in other projects. The result is a new hospital bed which is less expensive and more reliable by using fewer parts and in many cases parts which serve multiple functions.

It is to be understood that the embodiments described above are merely illustrative examples of the invention disclosed herein, and may be modified in many ways within the scope and spirit of this invention, as defined in the claims following.

I claim:

1. In a hospital bed described in upright orientation and operable with at least one IV-tube support rod, the bed including an upper frame for supporting a mattress, said upper frame having opposite head-end and foot-end sections and an intermediate thigh section, which sections are each tiltable relative to the others, said bed further including means for tilting each section, and a middle frame for pivotally supporting said upper frame sections, the improvement in combinations therewith wherein said middle frame comprises two longitudinal beams having head and foot ends corresponding to said upper frame ends, said head-end of the middle frame comprising a "U" shaped tubular member, with the bottom of the "U" extending transverse of and fixed to the head ends of said beams, and the arms of the "U" extending generally upward, each arm of the "U" including an opening for receiving and holding in the bore thereof said IV-tube support rod.

2. In a hospital bed described in upright orientation and operable with an IV-tube support rod, the bed including an upper frame for supporting a mattress, said upper frame having opposite head-end and foot-end sections and an intermediate thigh section, which sections are each tiltable relative to the others, said bed further including means for tilting each section, and a middle frame for pivotally supporting said upper frame sections, the improvement in combination therewith wherein said middle frame is a generally rigid structure comprising (a) head and foot ends corresponding to those of the upper frame, (b) opposite side parts, (c) a support plate on each of said side parts, each support plate comprising a lower portion secured to one of said side parts, an upper portion and an intermediate wall portion, (d) means for pivotally securing and supporting said upper and thigh sections of the upper frame to said upper portion of the support plate, and (e) a tubular beam extending transversely of said side parts and secured to the intermediate wall portions of said plates, said beam having a bore therethrough whose ends define openings through which said IV-tube support rod is insertable to be stored in said bore.

3. A hospital bed according to claim 2 wherein said support plates each comprise a single sheet of metal having side edges, first flanges bent from said side edges, and a second flange bent from said upper portion, said second flange including a generally vertical part to which said upper frame is pivotally connected and a generally horizontal part which includes an aperture for receiving and holding said IV-tube support rod.

4. In a hospital bed described in upright orientation and operable with at least one IV-tube support rod, the bed including an upper frame for supporting a mattress, said upper frame having opposite head-end and foot-end sections and an intermediate thigh section, which sections are each tiltable relative to the others, said bed further including means comprising three rotatable drive shafts for tilting each section, and a middle frame for pivotally supporting said upper frame sections, the improvement in combination therewith wherein said middle frame is a generally rigid structure comprising head and foot ends corresponding to those of the upper frame and opposite side parts, said foot-end of said middle frame comprising a beam extending transverse of and fixed to the foot-ends of said side parts, said beam in section defining a channel having upper and lower flanges, an intermediate web section, and an open side which faces away from said head-end, said upper flange including therein at least one aperture for receiving said IV-tube support rod, and said lower flange supports said rod, and said web section has defined therein at least three apertures through which said drive shafts extend.

5. In a hospital bed described in upright orientation, the bed including a base, a middle frame supported by the base, an upper frame supported by the middle frame, the upper frame having head, thigh and foot sections, each tiltable relative to the others, and means for tilting each of said upper frame sections, the improvement in combination therewith wherein said middle frame is a generally rectangular, open frame comprising two side members, and first and second end members which together define a reference plane, said side members being longitudinal beams having head and foot ends, said first end member being generally "U" shaped with the bottom of the "U" fixed to the head-ends of said beams, and the arms of the "U" extending generally upward and having means for mounting a headboard therebetween, said second end member extending between and fixedly engaged to the foot-ends of said beams, and said middle frame further comprising two support plates, each secured to one of said longitudinal beams intermediate the ends thereof and extending generally upward, and said upper frame being pivotally secured to and supported by said support plates.

6. A hospital bed according to claim 5 and operable with at least one IV-tube support rod, wherein said first end member comprises a tube bent into said "U" shape, the end of each arm of said "U" being open for receiving in the bore thereof said IV-tube support rod.

7. A hospital bed according to claim 5 wherein each of said support plates defines an acute angle with said reference plane and said two plates define an obtuse angle between them.

8. A hospital bed according to claim 5 wherein said longitudinal beams and said first end member comprise tubes having rectangular cross-sections.

9. A hospital bed according to claim 5 wherein each of said support plates comprises first and second longitudinally spaced connection means, said head section of the upper frame is pivotally secured to the first connection means of said plates, said thigh section is pivotally secured to the second connection means of said plates, and the foot section of said upper frame is pivotally secured to the thigh section.

10. In a hospital bed described in upright orientation, the bed including a base, a middle frame supported by the base, an upper frame supported by the middle frame, the upper frame having head, thigh and foot sections, each tiltable relative to the others, and means for tilting each of said upper frame sections, the improvement in combination therewith wherein said middle frame is a generally rectangular, open frame comprising two side members, and first and second end members which together define a reference plane, said side members being longitudinal beams having head and foot ends, said first end member being generally "U" shaped with the bottom of the "U" fixed to the head-ends of said beams, and the arms of the "U" extending generally upward, said second end member extending between and fixedly engaged to the foot-ends of said beams, said middle frame further comprising two support plates, each secured to one of said longitudinal beams intermediate the ends thereof and extending generally upward, and said upper frame being pivotally secured to and supported by said support plates, said first end member further comprising a headboard bracket near the end of each arm thereof, each bracket being formed from a single sheet and in upright orientation comprising a generally vertical main wall having top and bottom ends and side edges, said top end bent to form a generally horizontal top tab which includes an aperture therein, said bottom end bent to form a generally horizontal bottom tab aligned with the top tab, and said side edges of each bracket bent to form a pair of generally vertical blades defining a track therebetween, each bracket secured to one of said arms of the "U" with said top tab covering the end of the arm, the bottom tab extending into the arm, and said blades extending toward the other of said arms of the "U", and a headboard situated between said arms of the "U" and having side edges in and guided by said tracks on said arms, said top tab being adapted to receive an IV-tube support rod through the aperture therein, and said bottom tab positioned to stop and support said rod.

11. In a hospital bed described in upright orientation, the bed including a base, a middle frame supported by the base, an upper frame supported by the middle frame, the upper frame having head, thigh and foot sections, each tiltable relative to the others, and means for tilting each of said upper frame sections, the improvement in combination therewith wherein said middle frame is a generally rectangular, open frame comprising two side members, and first and second end members which together define a reference plane, said side members being longitudinal beams having head and foot ends, said first end member being generally "U" shaped with the bottom of the "U" fixed to the head-ends of said beams, and the arms of the "U" extending generally upward, said second end member extending between and fixedly engaged to the foot-ends of said beams, said middle frame further comprising two support plates, each secured to one of said longitudinal beams intermediate the ends thereof and extending generally upward, and said upper frame being pivotally secured to and supported by said support plates, each support plate comprising upper, middle and lower parts with an aperture in each middle part, and said middle frame further comprising a tubular beam extending between and fixedly engaging said support plates with the bore of such tubular beam aligned with the apertures in the plates, whereby the aperture in each plate is exposed and provides access to the bore of the tubular beam for storage space.

12. A hospital bed according to claim 11 and operable with at least one IV-tube support rod, wherein each of said support plates is formed from a single sheet comprising upper and lower parts and side edges, and first flanges bent from said side edges, and a second flange bent from the upper part and extending generally horizontally and including therein at least one aperture for receiving said IV-tube support rod.

13. A hospital bed according to claim 11 wherein each of said support plates comprises a generally flat wall portion between said upper and lower parts thereof, said wall portion including therein a plurality of apertures for lightening the plate and for providing a corresponding number of cut-out pieces.

14. In a hospital bed described in upward orientation, the bed including a base, a middle frame supported by the base, an upper frame supported by the middle frame, the upper frame having head, thigh and foot sections, each tiltable relative to the others, and means for tilting each of said upper frame sections, the improvement in combination therewith wherein said middle frame is a generally rectangular, open frame comprising two side members, and first and second end members which together define a reference plane, said side members being longitudinal beams having head and foot ends, said first end member being generally "U" shaped with the bottom of the "U" fixed to the head-ends of said beams, and the arms of the "U" extending generally upward, said second end member extending between and fixedly engaged to the foot-ends of said beams, said middle frame further comprising two support plates, each secured to one of said longitudinal beams intermediate the ends thereof and extending generally upward, and said upper frame being pivotally secured to and supported by said support plates, and said second end member comprising an end beam which in section defines a channel having upper and lower flanges and an intermediate web section, and an open side which faces away from said first end member.

15. A hospital bed according to claim 14 and operable with at least one IV-tube support rod, wherein said second end member includes at least one aperture in its upper flange for receiving said IV-tube support rod, and said lower flange supports said rod.

16. A hospital bed according to claim 14 wherein said means for tilting the upper frame sections comprise three rotatable drive shafts, and wherein the web section of said second end member has defined therein at least three apertures through which said drive shafts extend.

17. In a hospital bed described in upward orientation, the bed including a base, a middle frame supported by the base, an upper frame supported by the middle frame, the upper frame having head, thigh and foot sections, each tiltable relative to the others, and means for tilting each of said upper frame sections, the improvement in combination therewith wherein said middle frame is a generally rectangular, open frame comprising two side members, and first and second end members which together define a reference plane, said side members being longitudinal beams having head and foot ends, said first end member being generally "U" shaped with the bottom of the "U" fixed to the head-ends of said beams, and the arms of the "U" extending generally upward, said second end member extending between and fixedly engaged to the foot-ends of said beams, said middle frame further comprising two support plates, each secured to one of said longitudinal beams intermediate the ends thereof and extending generally upward, and said upper frame being pivotally secured to and supported by said support plates, said middle frame further comprising a footboard bracket secured near each of said foot-ends of the longitudinal beams, each footboard bracket being formed from a single sheet and comprising an end wall oriented generally parallel to said second end member, and at least one side arm oriented generally parallel to said longitudinal beams, a footboard secured to the end walls of said two footboard brackets, and at least one movable side rail having two ends, said side rail having one end movably secured to the side arm of one of the footboard brackets and the other end movably secured to said first end member.

* * * * *